US005791256A

United States Patent [19]

Johnson et al.

[11] Patent Number: 5,791,256

[45] Date of Patent: Aug. 11, 1998

[54] AXLE SPRUNG MOTOR

[75] Inventors: Steven Dallas Johnson, Lombard; Robert Thomas Scott, Lockport; William Ellis Darnaby, Burr Ridge, all of Ill.

[73] Assignee: General Motors Corporation, Detroit, Mich.

[21] Appl. No.: 804,537

[22] Filed: Feb. 21, 1997

[51] Int. Cl.[6] ..... B60K 1/00

[52] U.S. Cl. ..... 105/136

[58] Field of Search ..... 105/133, 136, 105/137, 138, 140, 172, 96.1

[56] References Cited

U.S. PATENT DOCUMENTS

| | | | |
|---|---|---|---|
| 448,562 | 3/1891 | Depoele . | |
| 484,914 | 10/1892 | Hunt . | |
| 496,330 | 4/1893 | Depoele . | |
| 529,671 | 11/1894 | Depoele . | |
| 572,685 | 12/1896 | Robinson . | |
| 1,575,766 | 3/1926 | Jackson . | |
| 1,580,803 | 4/1926 | Batchelder | 105/136 |
| 1,626,662 | 5/1927 | Bethel | 105/133 |
| 1,813,140 | 7/1931 | Bechel . | |
| 2,277,835 | 3/1942 | Alben | 105/131 |
| 2,501,307 | 3/1950 | Binney | 105/136 |
| 2,688,937 | 9/1954 | Giger | 105/131 |
| 3,453,971 | 7/1969 | Ishizawa | 105/131 |
| 3,762,336 | 10/1973 | Gooch | 105/136 |
| 3,765,734 | 10/1973 | Peterson | 308/132 |
| 3,858,525 | 1/1975 | Butine et al. | 105/136 |
| 4,228,739 | 10/1980 | Fitzgibbon | 105/140 |
| 4,278,028 | 7/1981 | Eichinger et al. | 105/136 |
| 4,841,873 | 6/1989 | Goding et al. | 105/168 |

FOREIGN PATENT DOCUMENTS

| | | | |
|---|---|---|---|
| 1455044 | 4/1969 | Germany | 105/136 |
| 129169 | 1/1947 | Switzerland | 105/136 |
| 143042 | 7/1948 | Switzerland | 105/136 |

*Primary Examiner*—Mark T. Le
*Attorney, Agent, or Firm*—Jeffrey A. Sedlar

[57] ABSTRACT

An axle sprung motor assembly for driving a locomotive includes a motor selectively driving a rotatable drive gear. A wheelset assembly includes a pair of flanged wheels mounted on an axle with an axle bearing housing rotatably supported on the axle. A set of resilient bushings is carried between the axle bearing housing and the motor housing. The motor assembly is resiliently secured to the wheelset through the interposed resilient bushings. A resilient gear has a hub fixed to the axle and includes a ring gear that engages the drive gear and is mounted to the hub through a set of flex bushings and a set of snubber bushings. Loads transferred from the motor to the wheelset are reduced by relative rotation between the ring gear and the hub that compresses elastomeric material of the flex bushings, with movement limited by the snubber bushings.

3 Claims, 4 Drawing Sheets

AXLE SPRUNG MOTOR

TECHNICAL FIELD

The present invention relates to an axle sprung motor and more particularly, to a locomotive traction motor at least partially supported on the axle through an interposed suspension system that provides resiliency between sprung and unsprung masses of the locomotive.

BACKGROUND OF THE INVENTION

Within the art of locomotive traction motor drives, it is known to rigidly mount the electric traction motor to an axle housing so that at least a portion of the weight of the motor is borne by the axle. Generally, the motor is partially suspended on the frame of the carbody or the frame of an associated railway truck. Commonly, torque is transferred from a pinion drive gear on the motor to a larger gear on the driven axle. U.S. Pat. NO. 3,765,734 to Peterson discloses one such axle supported traction motor. One side of the motor frame is adapted for connection to a railway truck for support. The other side of the motor frame is adapted for connection directly to a drive axle. The motor is supported on the drive axle by a pair of generally cylindrical axially spaced bearings. Driving loads passed to the axle are supported by the bearings which comprise solid metal structures. Torque is transferred from the output drive gear of the motor to a driven gear of the axle.

Loads are imparted to a traveling locomotive wheelset by typically encountered track surfaces. It has been found that this results in dynamic forces that are transmitted from the wheelset back to the track structure. These dynamic forces are particularly undesirable when a locomotive is traveling at high speed over track irregularities. More specifically, the initial impact after a locomotive wheel meets a track discontinuity is referred to as the $P_1$ force, and the peak of secondary forces generated after the impact is referred to as the $P_2$ force. Referring to FIG. 10, the effect of generating $P_1$ and $P_2$ forces is demonstrated schematically. As the wheel A hits the discontinuity B, the $P_1$ force is generated as shown in the corresponding force versus time graph. The $P_2$ force, also shown in the graph, is the result of the locomotive's unsprung mass bouncing against the stiffness of the track and its supporting structure. The higher the mass, the higher the magnitude of the $P_2$ force. It is desirable to reduce the effects of $P_2$ force impacts.

The unsprung mass of a typical locomotive includes the mass of the wheels, axle and bearings. For a locomotive with an axle supported traction motor, the unsprung mass also includes approximately half the traction motor mass. It is known to attempt to reduce the weight of the motor, as a method of reducing the unsprung mass to control the $P_2$ forces in a locomotive with an axle supported traction motor. This generally entails reducing the size of the motor, which often has the obvious drawback of concurrently reducing torque output. Therefore, this solution is limited. It is also known to shift the motor weight bearing function from the axle to either the truck frame or the frame of the car body, both of which are sprung. These solutions generally require a complex and costly flexible drive system to transfer torque from the sprung traction motor to the unsprung drive axle. Accordingly, the need for a competitive and effective solution to reduce $P_2$ forces generated by an axle supported traction motor continues to exist.

SUMMARY OF THE INVENTION

It is an aspect of the present invention to provide an axle sprung motor that isolates two distinct inertia, the motor mass and the motor rotor inertia. The motor mass is isolated by putting resiliency between the wheelset and the motor frame. The rotational inertia of the rotor is isolated by using a resilient gear.

Preferably, the wheelset is mounted to the motor using a plurality of bolts that attach through an axle bearing housing. Resiliency is provided between the wheel set and the motor frame by a preferred use of two elastomeric bushings per bolt location to give an adequate amount of resiliency at the wheelset/motor interface. The bushings are provided in sets of axle housing bushings and motor housing bushings. Radial travel of the axle housing bushings is provided in a controlled manner through use of a clearance between a relatively thin rubber walled portion of the axle housing bushings and the axle bearing housing. The housing bushings are designed to be stiff in the axial direction to reduce spreading of the wheelset housing from the traction motor due to drive forces.

Advantageously, the resilient gear is adapted to isolate the rotational inertia of the traction motor rotor under low torque conditions. The gear has built in stops to limit the rotational travel of the gear relative to the hub under high torque conditions that therefore, reduces the amount of strain on the rubber used for resiliency. Isolation of the motor's rotor inertia is generally only needed at high speeds of the locomotive when the $P_2$ force would be high. The torque on the gear is relatively low at higher speeds and therefore, the resilient gear is tailored to isolate the rotor when most needed under high speed conditions.

The major components of the resilient gear preferably include a ring gear, two drive plates, a hub, a plurality of flex bushings, and a plurality of snubber bushings. The two drive plates are bolted to each side of the ring gear and transmit the torque to the bushings. The bushings then transmit the torque from the drive plates to the hub, that in-turn, transfers the rotational force to the axle. The torque is transmitted from the drive plates to the rubber bushings through bushing shoulder extensions that are lightly press fit into the drive plates. The flex bushings are pressed into the hub preloading their elastomeric component and giving resiliency to the gear. The snubber bushings are carried in an oversized hole providing clearance between themselves and the hub for rotationally directed movement between the ring gear and the hub. The snubber bushings also act as the stops to limit the rotational travel of the ring gear with respect to the hub and have a thin wall of rubber to reduce the impact force. During high torque conditions which generally occur at low speeds, the snubber bushings come into driving contact with the hub and take the majority of the torque. The rubber used for the bushings is preferably a high temperature, oil resistant nitrile rubber.

According to a preferred embodiment of the present invention described in greater detail herein, an axle sprung motor assembly is provided for driving a locomotive wheelset. The assembly includes a traction motor with a rotor carried in a motor housing having a selectively rotatable drive gear connected to the rotor. A wheelset assembly is engaged with a set of mounting openings in the motor housing. The wheelset assembly includes a pair of flanged wheels mounted on an axle with an axle bearing housing rotatably supported on the axle. The axle bearing housing includes extending upper and lower mounting flanges. A resilient motor housing bushing set is carried between the upper and lower mounting flanges and the motor housing. A corresponding set of bolts extends through a set of axle housing bushings, the upper and lower mounting flanges and the set of motor housing bushings, and the bolts engage the motor housing to resiliency secure the wheelset assembly to the motor.

With this preferred embodiment, a resilient gear isolates rotational inertia of the motor and includes a hub fixed to the axle. The hub has a plurality of openings that contain flex and snubber bushings. A pair of side plates are pressed onto shoulder extensions of the flex and snubber bushings under a light load, and a ring gear is fastened to the pair of drive plates. Loads transferred from the motor to the wheelset are reduced through relative rotation between the ring gear and the hub that compresses the elastomeric material of the flex bushings, and through flexing of the axle and motor housing bushings.

DESCRIPTION OF THE PREFERRED EMBODIMENT

Figure 1:
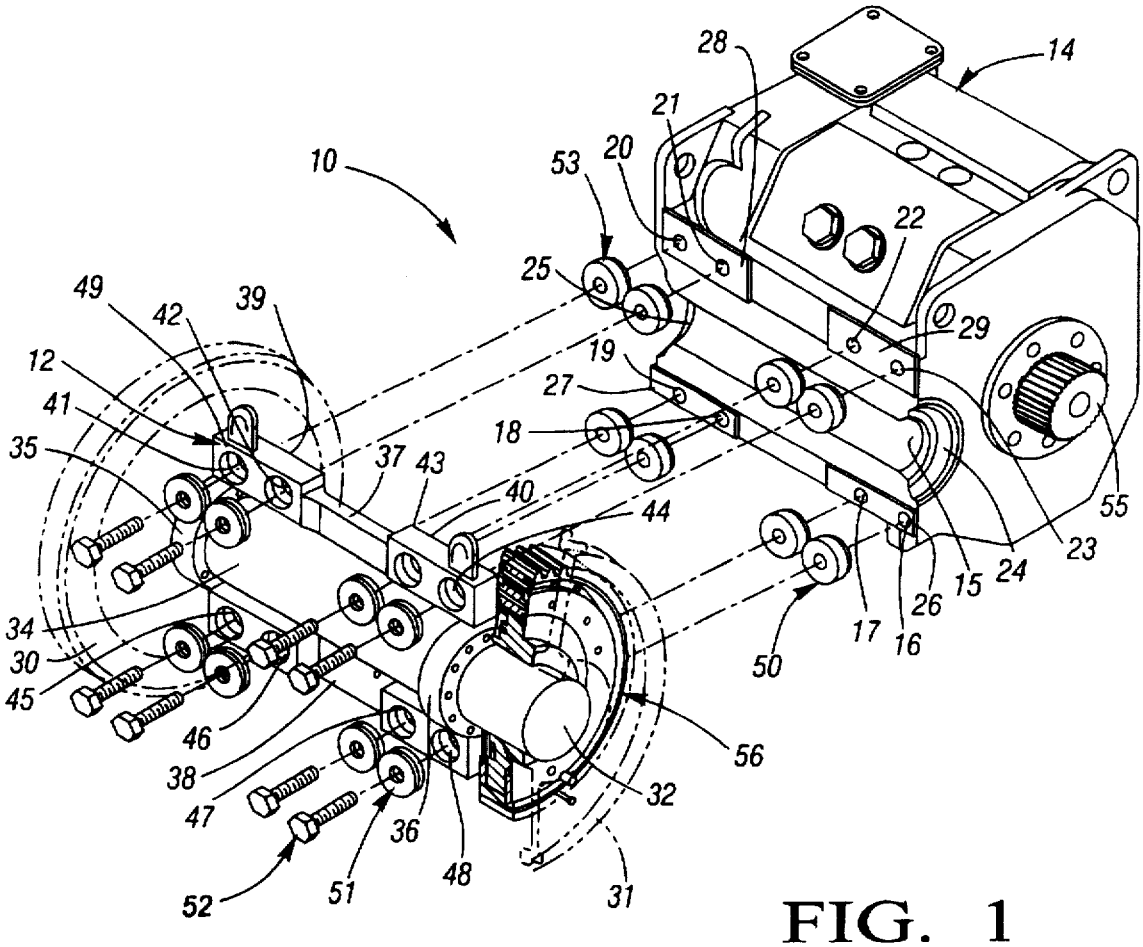
FIG. 1 is a fragmentary partially exploded perspective view of a traction motor and wheelset assembly in accordance with the present invention.

Referring to the drawings, illustrated in FIG. 1 is an axle sprung motor assembly designated in the aggregate as 10. Those components of most pertinence to the present invention are shown, and one skilled in the art will realize that the wheelset assembly 12 and motor assembly 14 are part of a two or three axle truck assembly as commonly found in electric motor driven locomotives such as diesel-electric locomotives. The motor assembly 14 is a relatively massive structure for driving a locomotive axle. Accordingly, the supporting structure provided to carry this weight over a varyingly smooth rail surface is critical. The motor assembly 14 includes a transverse semi-cylindrical opening 15 with a set of eight threaded openings 16–23 disposed in a paired pattern about the opening 15. Each end of the opening 15 includes an enlarged annular recess 24 and 25. The holes 16–23 are provided in substantially flat planar surfaces 26–29.

A mating wheelset assembly 12 includes the usual pair of flanged wheels 30 and 31 for mating with, and riding on, a pair of rails (not shown). The wheels 30 and 31 are fixed to a transverse axle 32 and rotate in concert. The axle 32 is rotatably mounted within an axle bearing housing 34 that carries a pair of journal boxes 35 and 36 for relatively low frictional engagement between the axle 32 and the axle bearing housing 34. The journal boxes 35, 36 employ a conventional bearing means such as tapered roller bearings or oil lubricated solid sleeve bearings (not shown), which support the axle bearing housing 34 and hold axle 32 against any significant end play. The axle bearing housing 34 includes an upper motor mounting flange 37 and a lower motor mounting flange 38. The upper motor mounting flange 37 includes a pair of substantially planar surfaces 39 and 40 for mating with the substantially planar surfaces 28 and 29 provided on corresponding motor rails of the motor assembly 14. Similarly, the lower motor mounting flange 38 includes a pair of substantially planar surfaces for mating with the substantially planar surfaces 26 and 27 provided on corresponding motor rails of the motor assembly 14.

Eight openings 41–48, are provided as a set in the upper and lower motor mounting flanges 37 and 38 and are located in correspondence with the threaded openings 16–23 of the motor assembly 14. Each of the openings 41–48 includes a countersunk portion representative of which is countersink 49 of opening 41. When the motor assembly 14 is brought together and mated with the wheelset assembly 12 the openings 16–23 align with the openings 41–48. Two sets of four motor housing bushings 50 and 53 are captured between the upper and lower motor mounting flanges 37 and 38 and the substantially planar surfaces 26–29 of the motor assembly 14 and may be contained within recesses (not shown), in the axle bearing housing 34. Similarly, a set of eight axle housing bushings 51 are received within the countersunk portions of openings 41–48.

Figure 2:
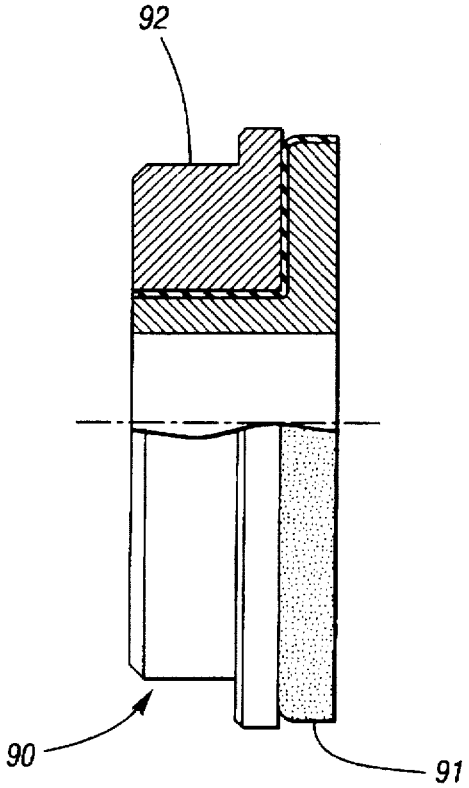
FIG. 2 is a fragmentary cross sectional illustration of a housing bushing used in the traction motor and wheelset assembly illustrated in FIG. 1.
Figure 3:
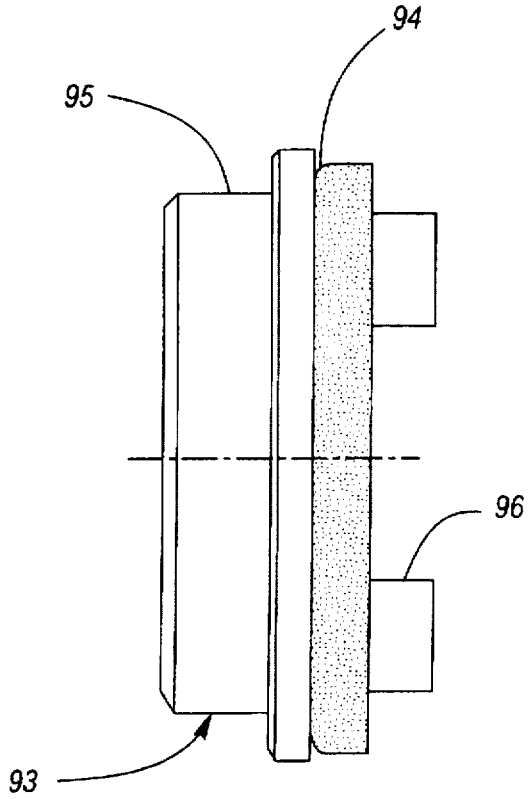
FIG. 3 is a detail illustration of a housing bushing used in the traction motor and wheelset assembly of FIG. 1.

Referring to FIG. 2, an example bushing is illustrated as bushing 90 and is used as the eight axle housing bushings 51 and the four motor housing bushings 53, specifically the upper four that mate with the substantially planar surfaces 28 and 29. The bushing 90 is generally annular in shape and includes a rubber ring 91 with a stepped profile, that is captured between a mating two-piece metal support 92. Referring to FIG. 3, an example illustrated as bushing 93 is used as the lower four motor housing bushings 50 that mate with the substantially planar surfaces 26 and 27 of motor assembly 14. The bushing 93 is generally annular in shape and includes a rubber ring 94 with a stepped profile like the rubber ring 91 of FIG. 2, that is captured between a mating two-piece metal support 95. The bushing 93 also includes a slot 96 for locating on the motor rails forming the planar surfaces 26 and 27 of the motor assembly 14. The bushings 90 and 93 are stiff in the axial direction to reduce spreading of the wheelset assembly 12 from the motor assembly 14 that may otherwise result from drive induced forces acting upon resilient material. Additionally, the countersinks 49 provide a slight radial clearance around the axle housing bushing set 51 providing controlled radial travel.

Referring again to FIG. 1, a set of eight bolts 52 are received through the corresponding set of eight bushings 51, the openings 41–48 and the eight bushings 50, 53, and are received within the threaded openings 16–23 of the motor assembly 14 for locking the motor assembly 14 to the wheelset assembly 12. With the motor assembly 14 mounted on the wheelset assembly 12, a significant portion of the weight of the motor assembly 14 is borne through the housing bushing sets 50, 51 and 53, and the bolts 52. The resilient mounting means comprising housing bushing sets 50, 51 and 53, is provided, since the wheelset assembly 12 rides along a rail and therefore, will be subjected to inputs provided by inconsistencies in the rail surface. The housing bushing sets 50, 51 and 53 reduce both the transfer of rail input forces to the motor assembly 14 and also reduce the effects of movements of the massive motor assembly 14 from being transferred as undesirable loads through the wheelset assembly 12.

Figure 4:
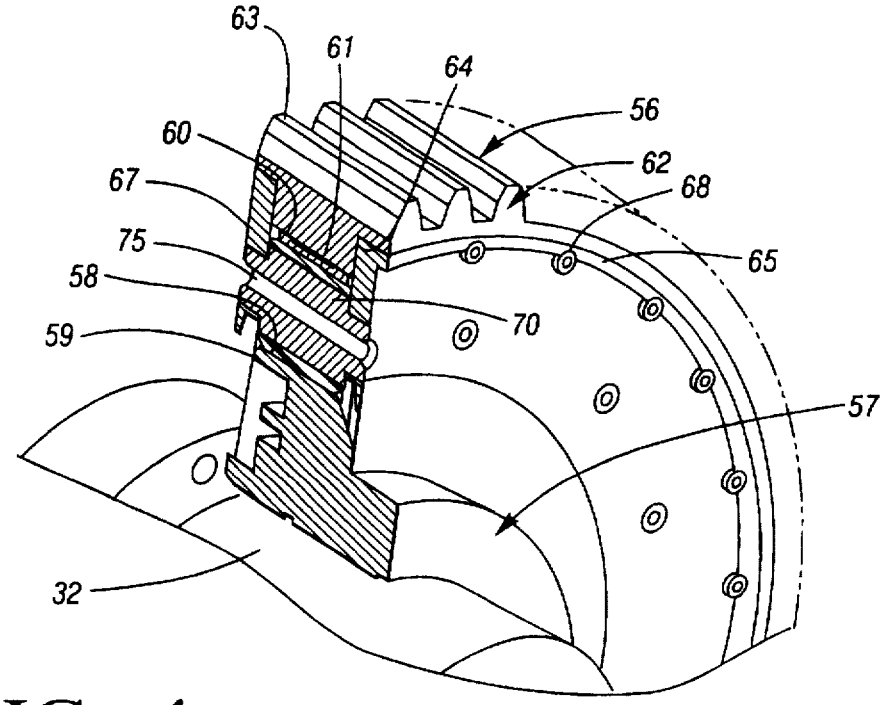
FIG. 4 is a detail perspective fragmentary cross sectional illustration of the resilient gear assembly of the traction motor and wheelset assembly illustrated in FIG. 1.

When the motor assembly 14 is mated with the wheelset assembly 12, the drive gear 55 engages a resilient gear assembly 56 that is fixed to the axle 32. Accordingly, rotation of the wheels 30 and 31 is effected by torque from the drive gear 55 of the electric motor assembly 14, that is transferred through the resilient gear assembly 56. Referring to FIG. 4, the resilient gear assembly 56 is illustrated in greater detail. The resilient gear assembly 56 includes a hub 57 that is fixed on the axle 32. The hub 57 is formed of a high strength alloy steel and is fixed between the wheel 31 and the journal housing 36 as seen in FIG. 1. The hub 57 has a generally annular shape and includes eight bushing openings, representative of which is bushing opening 58 that extends transversely through the flange 59 of the hub 57. The hub 57 also includes a groove for accepting a known labyrinth seal (not illustrated), against the journal box 48.

The resilient gear assembly 56 is designed to provide relative motion between the ring gear 62 and hub 57, which creates a rubbing surface between the hub outer diameter surface 60 and the gear inner diameter surface 61. To prevent fretting and galling of these features, both surfaces are preferably hardened. The mating surfaces are also lubricated by gear oil. A small channel (seen more clearly in FIG. 6), in the outer diameter of the hub 57 is used as an oil reservoir to assist in lubrication. The outer surface 60 of the hub 57 is hardened by a process such as nitriding. The inner surface 61 of ring gear 62 is hardened through a process such as carburizing.

The ring gear 62 includes a plurality of teeth 63 for mating with the drive gear 55 of the motor assembly 14. The ring gear 62 also includes an inner segment 64 of reduced lateral thickness, that is captured between a pair of side drive plates 65 and 67 with a set of bolts 68 disposed radially about the resilient gear assembly 56 rigidly securing the drive plates 65 and 67 to the ring gear 62. The sub-assembly comprising the drive plates 65, 67 and the ring gear 62 is resiliently mounted to the hub 57 through means of four resilient bushings, representative of which is flex bushing 70.

Figure 5:
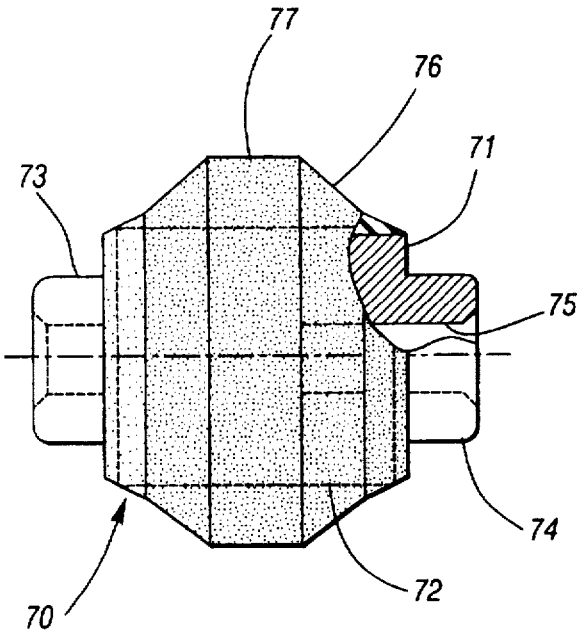
FIG. 5 is a detail illustration of a flex bushing used in the traction motor and wheelset assembly of FIG. 1.

Referring to FIG. 5, the flex bushing 70 is illustrated in greater detail. Flex bushing 70 includes a generally cylindrical body 71 made of steel that has a central section 72 with a pair of opposed shoulder extensions 73 and 74 of a reduced diameter. An opening 75 extends completely through the flex bushing 70 and is provided to facilitate manufacturing and assembly operations and remains open after final assembly. The central section 72 is surrounded by a quantity of resilient elastomeric material 76 such as rubber that is adhered to the body 71 through a conventional process. The elastomeric material 76 substantially surrounds the central section 72 and includes a relatively thick middle 77 of approximately 0.5 inches thickness in an uncompressed state, that tapers down toward the shoulder extensions 73 and 74.

Figure 6:
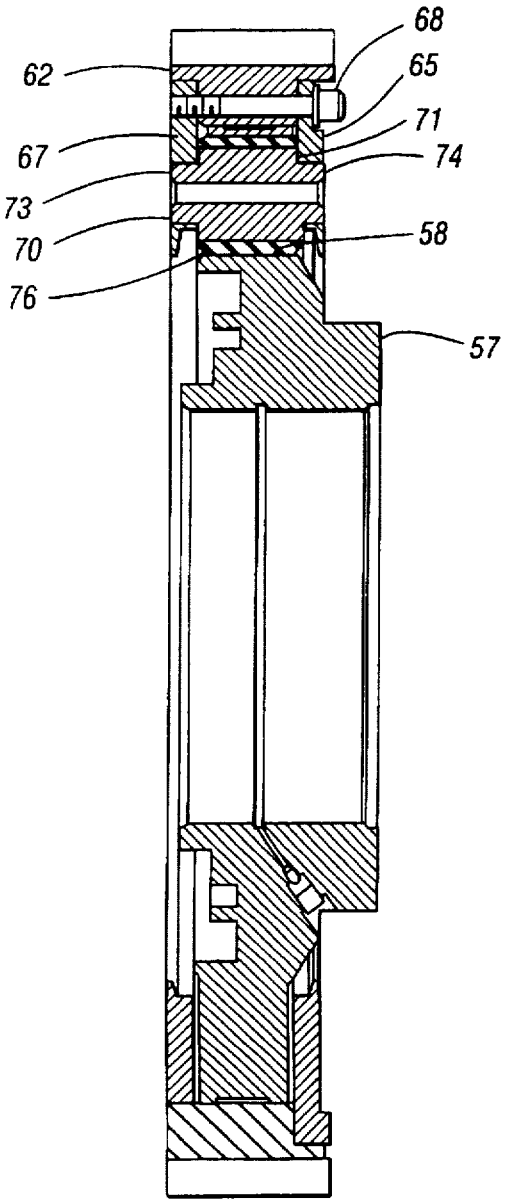
FIG. 6 is a cross sectional illustration of the resilient gear assembly of FIG. 7 taken generally through the plane indicated by the line 6—6 in FIG. 7.
Figure 7:
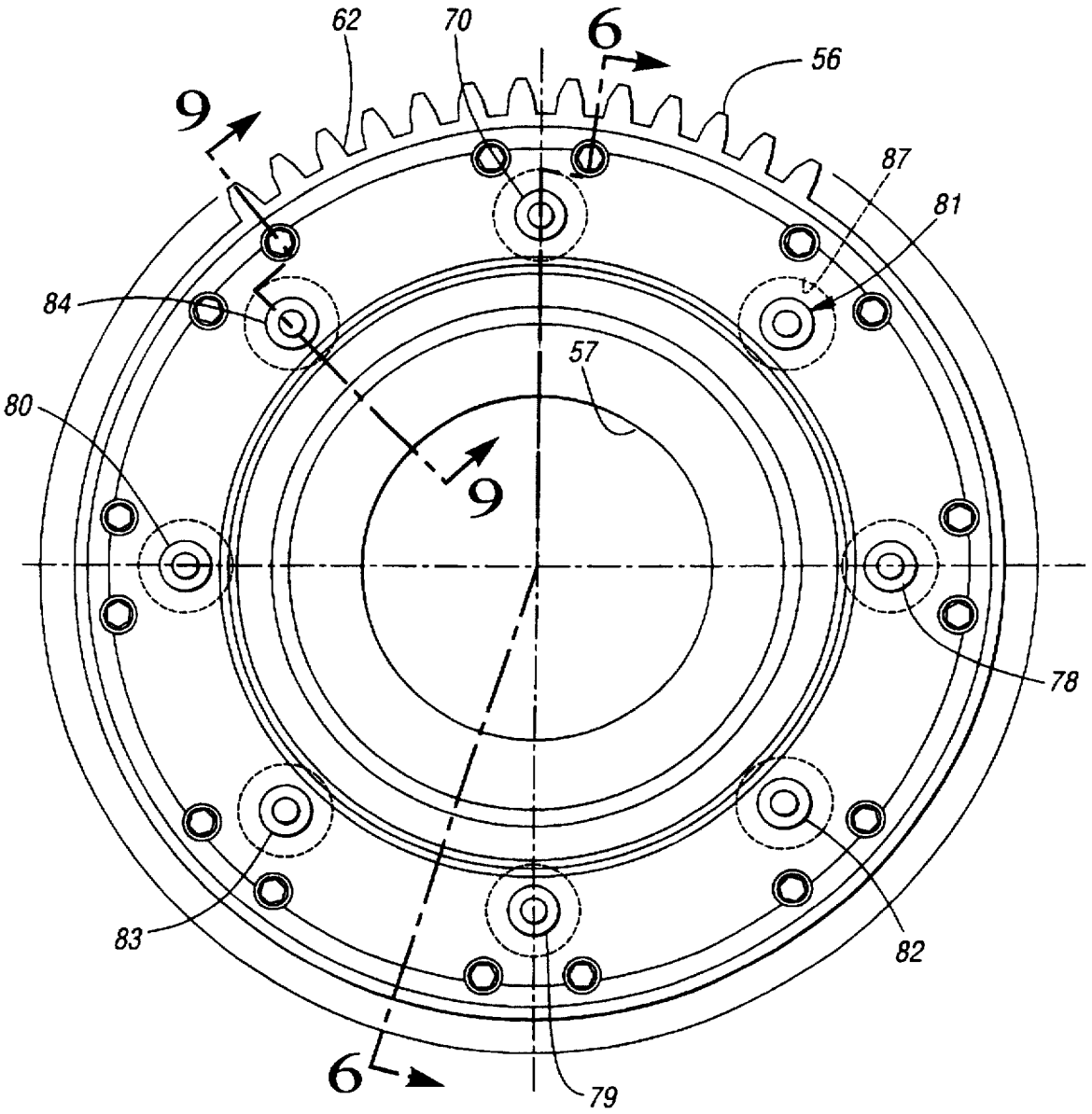
FIG. 7 is a detail illustration of the resilient gear assembly of the traction motor and wheelset assembly in FIG. 1.

As shown in FIG. 6, the flex bushing 70 is pressed into the bushing opening 58 of hub 57. As such, the elastomeric material 76 is substantially compressed resulting in a preload force tending to maintain the body 71 in a centered position within bushing opening 58. The shoulder extensions 73 and 74 are received into the drive plates 65 and 67, and the bolt 68 secures the assembly of the ring gear 62, the drive plates 65 and 67, the flex bushing 70 and the hub 57 together. Through means of the flex bushing 70, and accompanying flex bushings 78, 79, and 80 which are disposed around the resilient gear assembly 56 as shown in FIG. 7, relative movement between the ring gear 62 and the hub 57 is provided through compression of the elastomeric material 76 of the flex bushings 70 and 78–80.

Figure 8:
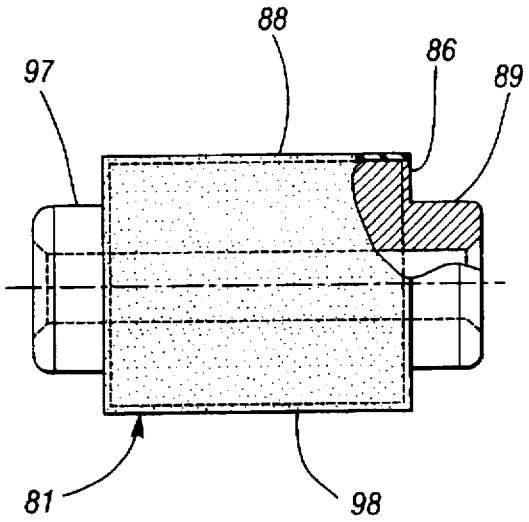
FIG. 8 is a detail illustration of a snubber bushing used in the traction motor and wheelset assembly of FIG. 1.

Resilient gear assembly 56 also carries four snubber bushings 81–84. The flex and snubber bushings are arranged in an alternating pattern around the resilient gear assembly 56. Referring to FIG. 8, the snubber bushings are shown in greater detail. The representative snubber bushing 81 includes a body 86 formed of steel with a cylindrical central section 88 having an integral opposed pair of shoulder extensions 97 and 89. The central section 88 is surrounded by a relatively thin band of resilient elastomeric material 98 such as rubber, that is adhered to the body 86 through a conventional process. The resilient elastomeric material 98 is provided in a layer approximately 0.06 inches thick around the central section 88.

Figure 9:
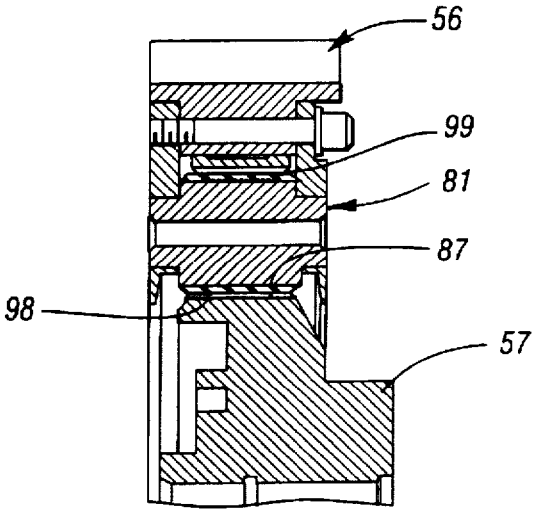
FIG. 9 is a cross sectional illustration of the resilient gear assembly of FIG. 7 taken generally through the plane indicated by the line 9—9 in FIG. 7.
Figure 10:
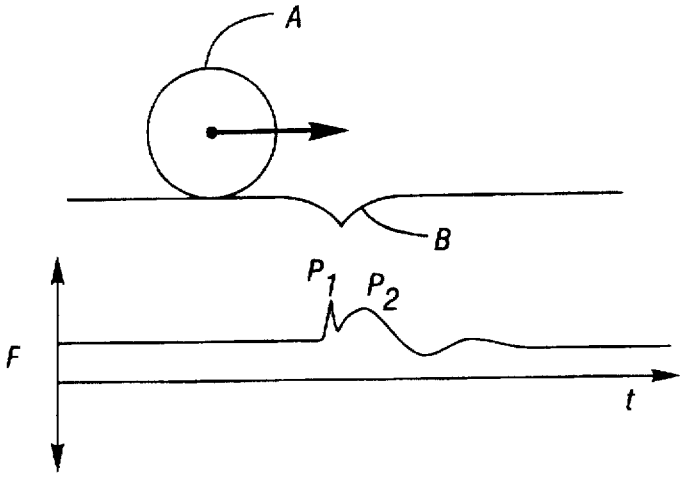
PRIOR ART FIG. 10
FIG. 10 is a schematic illustration of the operation of a prior art locomotive wheel.

Referring to FIG. 9, the snubber bushing 81 is shown assembled in the resilient gear assembly 56, positioned in the opening 87 in the hub 57. The opening 87 provides a total diametral clearance of a fraction of an inch around the snubber bushing 81. The thin layer of resilient elastomeric material 98 provides some suppression of circumferential impact loads between the snubber bushing 81 and the hub 57. The snubber bushings 81–84 are each borne in oversized openings indicated in FIG. 7 by opening 87, within which snubber bushing 87 is carried. Through means of the opening 87, controlled relative rotational motion is provided between the hub 57 and the assembly comprising the ring gear 62 and the sides plates 65 and 67. Movement is permitted through compression of the elastomeric material 76 carried by the flex bushings 70 and 78–80.

In operation of the motor assembly 14 driving the wheelset 12 along a railway with an inconsistent surface, the rails impart loads on the wheels 30 and 31. The initial impact resulting from the wheels 30 and 31 meeting a discontinuity in the railway results in the impartation of forces through the wheelset 12 to the motor assembly 14. This force transfer is somewhat reduced by the resilient nature of the housing bushing sets 50, 51 and 53. However, the transfer of a sufficient force of this nature results in movement of the massive motor assembly 14. The resulting load that is transferred back from the movement of motor assembly 14 to the wheelset 12 through the mounting structure is suppressed by the housing bushing sets 50, 51 and 53.

The resulting inertia generated load that is transferred back from the movement of motor assembly 14 to the wheelset 12 imparted from the motor's rotor through the output gear 55, is reduced by the resilient gear assembly 56. This is achieved through a controlled amount of relative rotational movement effected under force between the ring gear 62 and the hub 57. The applied force from rotational inertia of the motor assembly 14 through the output gear 55 compresses the elastomeric material 76 of the flex bushings 70 and 78–80. The snubber bushings 81–84 allow the resiliency of the elastomeric material 76 to operate within a prescribed range to reduce the transfer of forces caused by movement of the motor assembly 14 back to the wheelset assembly 12. This reduces the forces that are transferred from the wheelset assembly 12 to the railway. Force transfer reduction is particularly important in high speed applications wherein the speed and moving mass might otherwise result in the transfer of significant forces. A positive stop is provided by the enlarged openings 87 provided about the snubber bushings 81–84 limiting the amount of relative rotational movement between the ring gear 62 and the hub 57.

Through means of the present invention the reduction of dynamic forces imparted from a locomotive wheelset to the track structure when a locomotive is traveling at high speed over track irregularities is reduced. The force is suppressed by reducing the effect of the $P_2$ force that results from the unsprung mass bouncing on the stiffness of the track and its supporting structure. Through the unique arrangement of the present invention, the effects of this force are reduced while radial loads are securely supported and loads over a given amount are contained by a positive stop feature.

We claim:

1. An axle sprung motor assembly for driving a locomotive comprising:

a motor including a motor housing having a set of mounting openings and a selectively rotatable drive gear;

a wheelset assembly including a pair of wheels mounted on an axle with an axle housing rotatably supported on the axle with an upper mounting flange extending from the axle housing and a lower mounting flange extending from the axle housing;

a set of resilient motor housing bushings carried between the upper and lower mounting flanges and the motor housing;

a set of bolts extending through a set of axle housing bushings, the upper and lower mounting flanges and the set of motor housing bushings, and engaging the motor housing to resiliently secure the wheelset assembly to the motor; and a resilient gear having a hub fixed to the axle, the hub having a plurality of first openings containing a set of flex bushings and a plurality of second, oversized openings containing a set of snubber bushings, the flex bushings each including a flex bushing central section surrounded by a relatively thick amount of elastomeric material and pressed into the first openings, with a first pair of shoulder extensions formed with the flex bushing central section, the snubber bushings each including a snubber bushing central section surrounded by a relatively thin amount of elastomeric material and positioned in the second oversized openings with a second pair of shoulder extensions formed with the snubber bushing central section, the resilient gear including a pair of drive plates engaging the first and second pairs of shoulder extensions of the flex bushings and the snubber bushings, and a ring gear fastened to the pair of drive plates and engaging the drive gear of the motor, wherein loads transferred from the motor to the wheelset are reduced by relative rotation between the ring gear and the hub that compresses the elastomeric material of the flex bushings.

2. An axle sprung motor assembly for driving a locomotive comprising:

a motor of substantial mass including a motor housing having a set of mounting openings, each formed in a substantially planar surface of the motor housing, the motor also including a selectively rotatable drive gear;

a wheelset assembly including a pair of flanged wheels mounted on an axle with an axle housing containing a pair of journal boxes rotatably supporting the axle housing on the axle with an upper mounting flange extending from the axle housing and including a plurality of first countersunk openings and a lower mounting flange extending from the axle housing and including a plurality of second countersunk openings;

a set of resilient motor housing bushings carried between the upper and lower mounting flanges and the motor housing;

a set of axle housing bushings carried in the first and second countersunk openings;

a set of bolts extending through the set of axle housing bushings, the upper and lower mounting flanges and the set of motor housing bushings, and engaging the motor housing to resiliently secure the wheelset assembly to the motor; and a resilient gear having a hub fixed to the axle, the hub having a plurality of circular openings containing a set of flex bushings and a plurality of oversized openings containing a set of snubber bushings, the flex bushings each including a flex bushing central section surrounded by a relatively thick amount of elastomeric material and pressed into the circular openings, with a first pair of shoulder extensions formed with the flex bushing central section, the snubber bushings each including a snubber bushing central section surrounded by a relatively thin amount of elastomeric material and positioned in the oversized openings with a second pair of shoulder extensions formed with the snubber bushing central section, the resilient gear including a pair of drive plates engaging the first and second pairs of shoulder extensions of the flex bushings and the snubber bushings, and a ring gear fastened to the pair of drive plates and engaging the drive gear of the motor, wherein loads transferred from the motor to the wheelset are reduced through relative rotation between the ring gear and the hub that compresses the elastomeric material of the flex bushings.

3. An axle sprung motor assembly for driving a locomotive comprising:

a motor of substantial mass including a motor housing having a set of mounting openings, each formed in a substantially planar surface of the motor housing, the motor also including a selectively rotatable drive gear;

a wheelset assembly including a pair of flanged wheels mounted on an axle with an axle housing containing a pair of journal boxes rotatably supporting the axle housing on the axle with an upper mounting flange extending from the axle housing and including a plurality of first countersunk openings and a lower mounting flange extending from the axle housing and including a plurality of second countersunk openings;

a set of resilient motor housing bushings carried between the upper and lower mounting flanges and the substantially planar surfaces of the motor housing;

a set of axle housing bushings carried in the first and second countersunk openings;

a set of bolts extending through the set of axle housing bushings, the upper and lower mounting flanges and the set of motor housing bushings, and engaging the motor housing to resiliently secure the wheelset assembly to the motor; and a resilient gear having a hub fixed to the axle, the hub having a plurality of circular openings containing a set of flex bushings and a plurality of oversized openings containing a set of snubber bushings, the flex bushings each including a flex bushing central section surrounded by a relatively thick amount of elastomeric material of approximately 0.5 inches thickness in an uncompressed state and pressed into the circular opening, with a first pair of shoulder extensions formed with the flex bushing central section with an axial opening extending completely through each flex bushing, the snubber bushings each including a snubber bushing central section surrounded by a relatively thin amount of elastomeric material of approximately 0.06 inches thickness and positioned in the oversized openings with a second pair of shoulder extensions formed with the snubber bushing central section with an axial opening extending completely through each snubber bushing, the resilient gear including a pair of drive plates engaging the first and second pairs of shoulder extensions of the flex bushings and the snubber bushings, and a ring gear fastened to the pair of drive plates and engaging the drive gear of the motor, wherein loads transferred from the motor to the wheelset are reduced by a relative rotation between the ring gear and the hub that compresses the elastomeric material of the flex bushings, wherein the relative rotation is limited by engagement of the snubber bushings with the hub in the oversized openings and wherein vertical forces are supported by engagement between the ring gear and the hub.

* * * * *